US008971763B2

(12) United States Patent
Takahashi

(10) Patent No.: US 8,971,763 B2
(45) Date of Patent: Mar. 3, 2015

(54) IMAGE HEATING APPARATUS AND BELT EXCHANGING METHOD

(71) Applicant: Canon Kabushiki Kaisha, Tokyo (JP)

(72) Inventor: Masahiro Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 13/913,874

(22) Filed: Jun. 10, 2013

(65) Prior Publication Data

US 2013/0330103 A1 Dec. 12, 2013

(30) Foreign Application Priority Data

Jun. 11, 2012 (JP) ..... 2012-131782

(51) Int. Cl.
*G03G 15/16* (2006.01)
*G03G 21/16* (2006.01)
*G03G 15/20* (2006.01)

(52) U.S. Cl.
CPC ..... *G03G 21/1685* (2013.01); *G03G 15/2039* (2013.01); *G03G 15/2053* (2013.01); *G03G 2215/2035* (2013.01)
USPC ..... 399/122

(58) Field of Classification Search
CPC ..... G03G 15/2067; G03G 15/2064; G03G 15/2053; G03G 15/2078
USPC ..... 399/122
See application file for complete search history.

(56) References Cited

U.S. PATENT DOCUMENTS

| | | | | |
|---|---|---|---|---|
| 5,525,775 | A | 6/1996 | Setoriyama et al. | |
| 7,440,713 | B2 * | 10/2008 | Sone et al. | 399/122 |
| 7,974,563 | B2 | 7/2011 | Sakai et al. | |
| 8,005,413 | B2 | 8/2011 | Sakakibara et al. | |
| 8,032,047 | B2 * | 10/2011 | Shiobara et al. | 399/69 |
| 8,224,223 | B2 | 7/2012 | Sakakibara et al. | |
| 8,369,763 | B2 | 2/2013 | Sakakibara et al. | |
| 8,401,450 | B2 | 3/2013 | Sekihara et al. | |
| 2011/0217092 | A1 | 9/2011 | Sekihara et al. | |
| 2012/0051806 | A1 | 3/2012 | Takahashi | |
| 2012/0251204 | A1 | 10/2012 | Takahashi | |
| 2013/0051875 | A1 | 2/2013 | Takahashi | |
| 2013/0202334 | A1 | 8/2013 | Takahashi | |

FOREIGN PATENT DOCUMENTS

| | | | |
|---|---|---|---|
| JP | 4-44075 | A | 2/1992 |
| JP | 4-204980 | A | 7/1992 |

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image heating apparatus comprising an endless belt for heating a toner image on a recording material; a holding member for holding the endless belt at an inside of the endless belt; a temperature sensor, provided inside the endless belt, for detecting a temperature of the endless belt; and a moving mechanism moved the temperature sensor between a first position for detecting the temperature of the endless belt and a second position for permitting the endless belt to be taken out of the holding member substantially along a longitudinal direction of the holding member.

19 Claims, 5 Drawing Sheets

(a)

(b)

IMAGE HEATING APPARATUS AND BELT EXCHANGING METHOD

FIELD OF THE INVENTION AND RELATED ART

The present invention relates to an image heating apparatus for heating a toner image on a recording material and a belt exchanging method therefor. The image heating apparatus can be used in an image forming apparatus such as a copying machine, a printer, a facsimile machine, a complex machine having a plurality of functions of such machines.

In a fixing device as the image heating apparatus, so-called heating roller type devices are widely used. In a fixing device of the heating roller type, a recording material carrying an unfixed toner image is passed through a nip formed between a fixing roller and a pressing roller which are press-contacted with each other and are rotated, by which the unfixed toner image is fixed into a fixed image on the recording material.

On the other hand, a fixing device an endless film (endless belt) heating type has been proposed, in which the electric power is not supplied in the fixing device in the stand-by period, thus saving the electric power (Japanese Laid-open Patent Application Sho, Japanese Laid-open Patent Application Hei, Japanese Laid-open Patent Application Hei 4-44075, and Japanese Laid-open Patent Application Hei 4-204980).

With such a fixing device, the pre-heating during the stand-by period is unnecessary, and the waiting time can be reduced because of the high heating efficiency and speedy start-up, and therefore, such a fixing device is advantageous over the heating roller type fixing device.

In addition, in such a fixing device, when the endless film is deteriorated due to a long term operation, not only the endless film, but the entire fixing unit is exchanged. From a standpoint of protection of the ambient condition, such an exchanging system involves a point to be improved.

In view of this, if an attempt is made to exchange only the endless film, the following inconvenience may arise.

More particularly, when the endless film is taken out of the fixing unit, a thermister (temperature sensor) and/or a grounding contact member (grounding member) provided inside the endless film may hit or bite the endless film. If this occurs, the thermister and/or the grounding contact member may be damaged.

In addition, when a fresh endless film is mounted to the fixing unit, the fresh endless film may be damaged by hitting the thermister and/or the grounding contact member. If this occurs, the endless film has to be exchanged immediately, again.

SUMMARY OF THE INVENTION

According to an aspect of the present invention, there is provided an image heating apparatus comprising an endless belt for heating a toner image on a recording material in a nip; a rotatable member for cooperating with said endless belt to form the nip and rotating said endless belt; a holding member, provided opposed to said rotatable member through said endless belt, for holding said endless belt at an inside of said endless belt and for contacting said endless belt to heat said endless belt; a contact member contacting an inner surface of the endless belt; and a retracting mechanism for retracting said contact member from said endless belt, and for maintaining the retracted state of said contact member when said endless belt is taken out of said holding member along a longitudinal direction of said holding member.

According to another aspect of the present invention, there is provided a belt exchanging method in an image heating apparatus which includes an endless belt for heating a toner image on a recording material in a nip, a rotatable member for cooperating with said endless belt to form the nip and rotating said endless belt, a holding member, provided opposed to said rotatable member through said endless belt, for holding said endless belt at an inside of said endless belt and for contacting said endless belt to heat said endless belt, and a contact member contacting an inner surface of the endless belt. The belt exchanging method comprises: a step of retracting said contact member from said endless belt; a step of taking said endless belt out of said holding member along a longitudinal direction of said holding member, in a state that said contact member is retracted from said endless belt; a step of telescoping an endless belt to replace the taken out endless belt along the longitudinal direction around said holding member in the state that said contact member is retracted from said endless belt; and a step of contacting said temperature sensor to an inner surface of the replaced endless belt.

These and other objects, features and advantages of the present invention will become more apparent upon a consideration of the following description of the preferred embodiments of the present invention taken in conjunction with the accompanying drawings.

DESCRIPTION OF THE EMBODIMENTS

The preferred embodiments of the present invention will be described in conjunction with the accompanying drawings.

<First Embodiment>

(Image Forming Apparatus)

Figure 2:
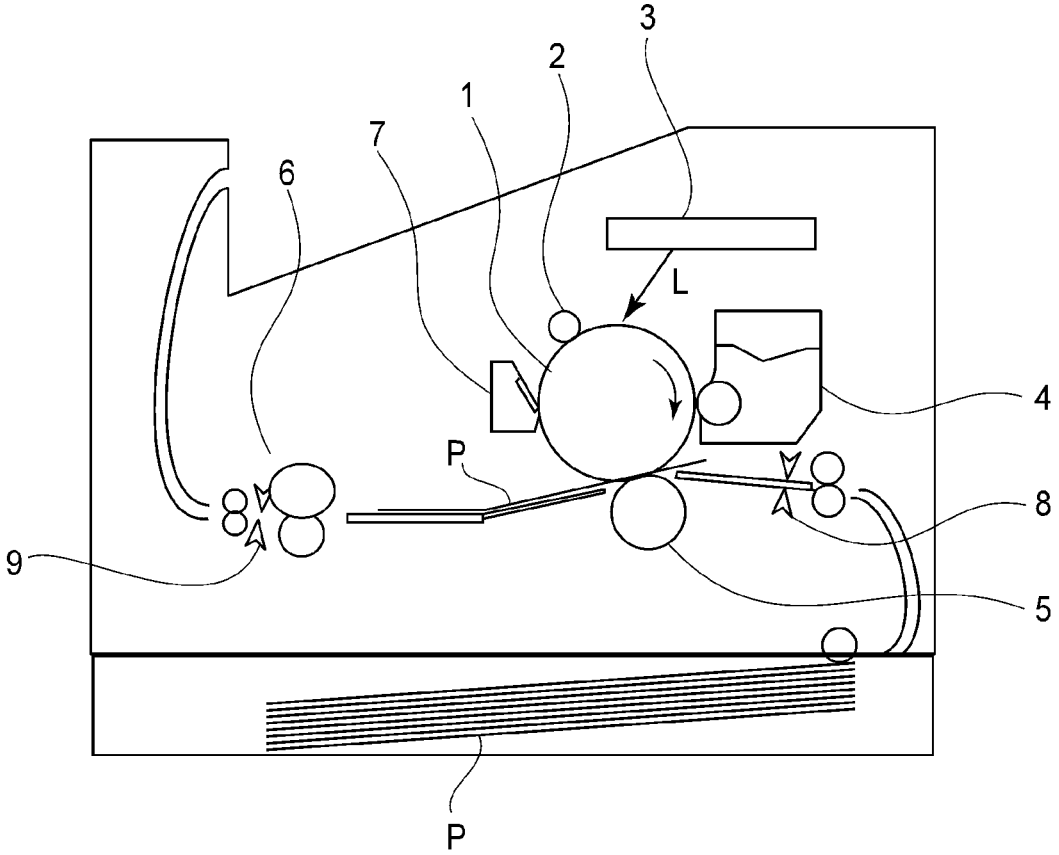
FIG. 2 is a schematic view of an image forming apparatus provided with the image heating apparatus according to the embodiment of the present invention.

Referring first to FIG. 2, there is shown a schematic sectional view of an image forming apparatus provided with a fixing device as an image heating apparatus according to this embodiment of the present invention. In FIG. 2, a photosensitive drum 1 as an image bearing member comprises a cylinder of aluminum or nickel and a photosensitive material such as OPC, amorphous Se or amorphous Si, thereon. The photosensitive drum 1 is rotated in a direction indicated by the arrow in FIG. 2, and the surface thereof is charged uniformly by a charging roller 2 as a charging means. Then, the photosensitive drum 1 is exposed to a laser beam L ON/OFF controlled in accordance with image information by a laser scanner 3, so that an electrostatic latent image is formed.

The electrostatic latent image is visualized by a developing device 4. As for the developing method, a jumping developing method, a two-component developing method, FEED developing method (contact type developing method using one component insulative toner) are usable, and a combination of an image exposure and a reverse development is widely used.

Toner image visualized toner image is transferred from the photosensitive drum 1 onto a recording material P fed at predetermined timing, by a transfer roller 5 as a transferring means. Here, in order to align the image forming position of the toner image on the photosensitive drum 1 with the writing start position at the leading end of the recording material, a sensor 8 is provided to detect the leading end of the recording material. The recording material P fed at the predetermined timing is nipped and fed with the predetermined pressure between the photosensitive drum 1 and the transfer roller 5. The recording material P having the transferred toner image is fed to a fixing device 6 as the image heating apparatus, where it is fixed into a fixed image.

On the other hand, residual toner remaining on the photosensitive drum 1 is removed from the surface of the photosensitive drum 1 by a cleaning device 7. A discharge sensor 9 is provided in the fixing device 6 to detect sheet jamming and functions to detect sheet jamming occurring between a top sensor 8 and the discharge sensor 9.

(Fixing Device)

Figure 3:
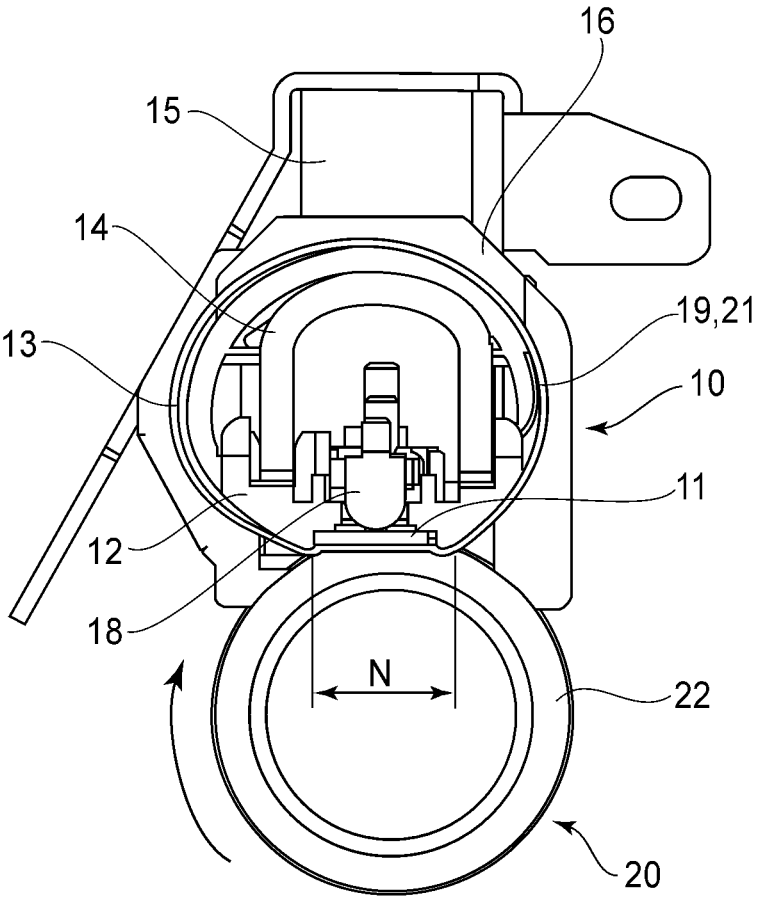
FIG. 3 is a sectional view of the fixing device as the image heating apparatus according to the embodiment of the present invention.
Figure 4:
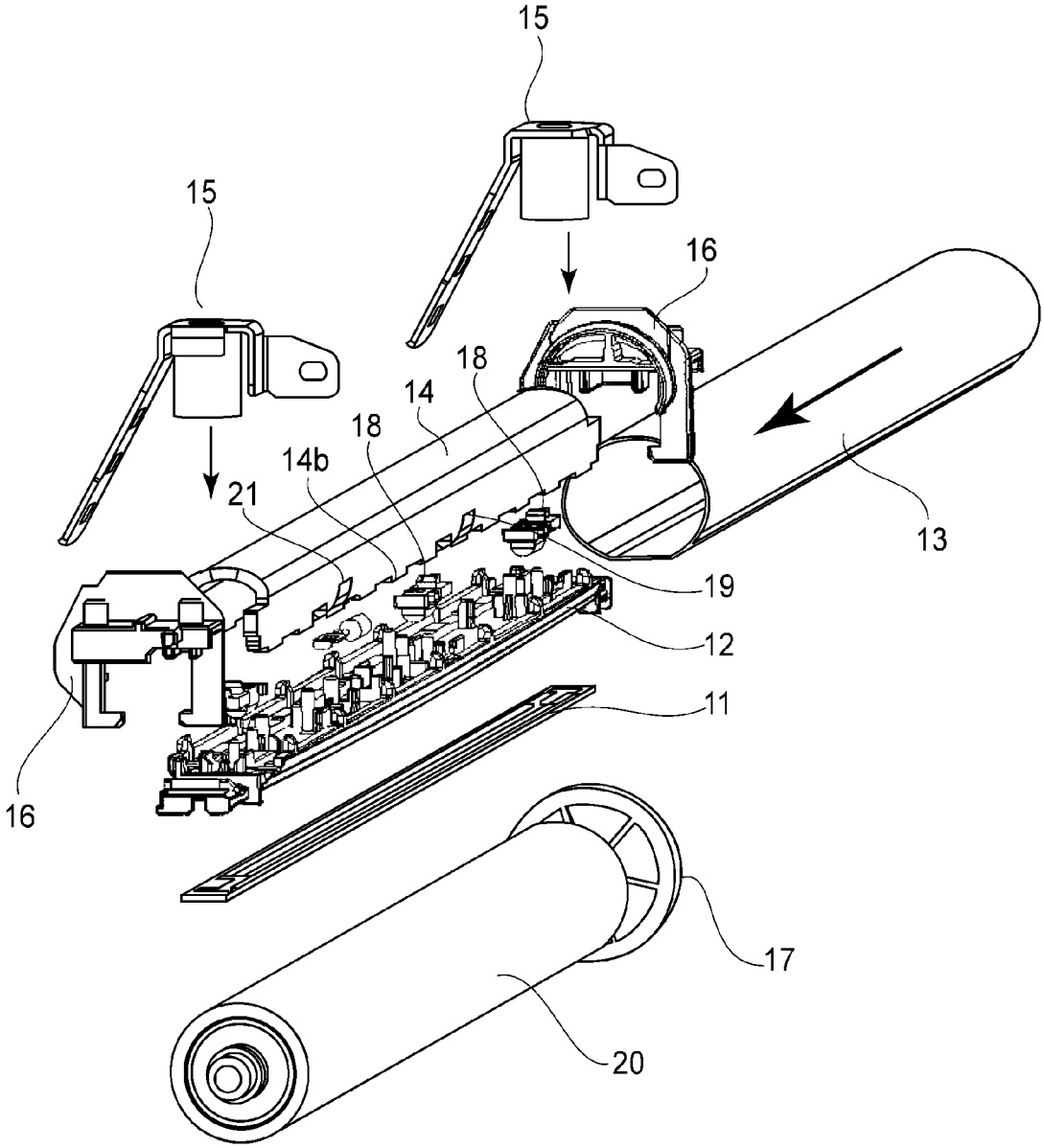
FIG. 4 is a perspective view of the fixing device as the image heating apparatus according to the embodiment of the present invention.

FIG. 3 is a schematic illustration of the fixing device 6 (FIG. 2) as the image heating apparatus, and FIG. 4 is a perspective view thereof. A fixing nip N is formed by a fixing assembly 10 and a pressing roller 20, and the recording material carrying the unfixed toner image is introduced into the fixing nip N to effect the heating and fixing. As shown in FIG. 3, the fixing assembly 10 comprises a fixing belt 13 (endless belt) as a flexible sleeve, which is rotated in a feeding direction of the recording material carrying the image, and an elongated heater (heating device) 11 which is elongated in the direction crossing with the feeding direction.

Furthermore, the fixing assembly 10 comprises a heat-insulation holder 12 holding the heater 11, and a metal stay 14 for holding the heat-insulation holder 12, the metal stay 14 contacting the heat-insulation holder 12 to suppress flexure and/or twisting of the entire fixing assembly 10.

Here, the heater 11, the heat-insulation holder 12 and the metal stay 14 function as a holding member for rotatably holding the fixing belt 13 at the inside thereof. The metal stay 14 is pressed by an urging spring 15 so that the holding member is urged to the pressing roller 20 disposed in the opposite side of the fixing belt 13.

The heater 11 is a ceramic heater and is held by a heat-insulation holder 12, and is made of a heat resistive resin material such as liquid crystal polymer, phenolic resin, PPS or PEEK. The heat conduction to the pressing roller 20 increases with a decrease of the thermal conductivity, and therefore, the resin material layer may comprise a filler such as glass balloon and/or silica balloon, wherein the filler it is effective to guide the rotation of the fixing belt 13.

(Fixing Belt)

In order to accomplish a quick start, the fixing belt 13 uses a heat resistive film having a total thickness not more than 200 μm. A base layer thereof is made of a heat resistive resin material such as polyimide, polyamide-imide or PEEK (polyetheretherketone), a pure metal or alloy of SUS (stainless steel), Al, Ni, Cu, Zn or the like having a heat resistivity and high thermo-conductivity.

In the case of a resin material base layer, it may comprise a high thermo-conductive powder such as BN, alumina or Al in order to enhance the thermo-conductivity. In order to enhance the lifetime of the heat-fixing device, it is preferable that the fixing belt 13 has a total thickness not more than 20 μm. Therefore, the optimum total thickness of the fixing belt 13 is not less than 20 μm and not more than 200 μm. Furthermore, in order to assure the toner offset prevention and the recording material separation property, the surface thereof is coated with a toner parting layer comprising a heat resistive resin material having good parting property, such as a silicone resin material or a fluorinated resin material such as a PTFE, PFA, FEP, ETFE, CTFE or PVDF, singly or as a mixture. In this embodiment, the surface layer comprises at least PTFE and PFA.

Here, PTFE is polytetrafluoroethylene, PFA is tetrafluoroethylene-perfluoroalkylvinyl ether copolymer, FEP is tetrafluoroethylene-hexafluoropropylene copolymer. In addition, ETFE is ethylene-tetrafluoroethylene copolymer, CTFE is polychlorotrifluoroethylene, and PVDF is polyvinylidene fluoride.

As for in a coating method, an outer surface of the fixing belt 13 is subjected to an etching process, and then the toner parting layer is formed by dipping, powder spray or the like. Alternatively, the fixing belt 13 is covered by the resin material formed into a tube shape. Or, the outer surface of the fixing belt 13 is subjected to a blast treatment, and then a primer layer which is an adhesive material is applied, and the toner parting layer is provided thereon.

(Pressing Roller)

The fixing belt 13 (endless belt) is driven by the pressing roller 20 functioning as a driving rotatable member. Pressing roller 20 is an elastic roller comprising a metal core 21 of SUS, SUM (sulfur-containing or sulfur-complex free-machining steel), Al or the like, and an elastic layer 22 of an elastic solid rubber layer, an elastic foam rubber layer or an elastic porous rubber layer or the like on the outside of the metal core 21. The elastic solid rubber layer is made of a heat resistive rubber such as silicone rubber or fluorine-containing rubber. The elastic foam rubber layer is silicone rubber foam having a heat-insulation effect.

The elastic porous rubber layer a silicone rubber layer containing hollow fillers (micro-balloon or the like) dispersed therein so that the cured material thereof contains gas to enhance the heat-insulation effect. The parting layer of the perfluoroalkoxy material (PFA), polytetrafluoroethylene material (PTFE) or the like may be provided thereon.

(Driving and Control Method for Fixing Device)

The fixing assembly 10 is urged against an elasticity of the pressing roller 20 to form the fixing nip N, in the following manner. The fixing assembly 10 is provided with a flange 16 functioning as a limiting member at each of opposite end portions thereof, and the flange 16 is connected with the metal stay 14. The flange 16 it is effective to limit movement of the fixing belt 13 in the longitudinal direction so that the fixing belt 13 is maintained within a predetermined zone with respect to the longitudinal direction thereof. The urging spring 15 urges the flange 16 toward the pressing roller 20 by which the force of the urging spring 15 is transmitted to the opposite end portions of the metal stay 14 through the flange 16.

As shown in FIG. 4, the metal stay 14 projects beyond the heat-insulation holder 12 at each of the opposite end portions with respect to the longitudinal direction, and is inserted into the flange 16 so that the flange 16 is pressed by a coil spring 15. The weight is transmitted uniformly over the longitudinal direction of the heat-insulation holder 12 through a stay foot portion 14*b*.

In the fixing nip N, the fixing belt 13 flexes by being nipped between the heater 11 and the pressing roller 20 by the pressure so that the fixing belt 13 is closely contacted to the heating surface of the heater 11. The pressing roller 20 receives a driving force for rotation in the direction indicated by the arrow in FIG. 3 by a 17 provided at an end portion of the core metal. The driving force is transmitted from a motor (unshown) in response to an instructions from the CPU.

In accordance with the rotation of the pressing roller 20, the fixing belt 13 is rotated (traveled) by a frictional force relative to the pressing roller 20. At this time, the fixing belt 13 slides on the heater 11. Between the fixing belt 13 and the heater 11, a lubricant such as fluorine or silicone type heat resistive grease is provided to reduce a frictional resistance to accomplish sliding rotation (traveling) of the fixing belt 13.

For a temperature control of the heater 11, the use is made with signals from a thermister 18 (temperature sensor) provided on a rear surface of a ceramic substrate supporting the heater 11, and a thermister 19 (temperature sensor) contacting to the inner surface of the fixing belt 13 to directly detect a temperature of the fixing belt. More particularly, in response to the signals, the CPU determines and controls the voltage (duty ratio and/or wave number or the like) to be applied to the heater 11 (electric heat generating resistance layer) so as to maintain the temperature in the fixing nip N at a desired target temperature.

Furthermore, the metal stay 14 is provided with a grounding contact member (grounding member) 21 for the purpose of grounding the fixing belt 13. The grounding contact member 21 and the thermister 19 are in such a positional relation that when the fixing belt 13 is mounted, they are in sliding contact with the inner surface of the fixing belt 13 with rotation of the fixing belt 13. More particularly, the grounding contact member 21 and the thermister 19 are mounting to the metal stay 14 (functioning as the holding member for supporting the fixing belt 13 together with the heat-insulation holder 12) so as to be elastically projected to contact to the inner surface of the fixing belt 13.

The recording material P covering the unfixed toner image it supplied by a supplying means (unshown) at the predetermined timing and is nipped and fed by the fixing nip N, during which the unfixed toner image it fixed by heat. The recording material P discharged from the fixing nip N is guided by the discharging guide and is finally discharged.

(Retracting Mechanism)

A description will be provided as to a retracting mechanism for retracting the thermister 19 and the grounding contact member 21, which function as contact members for contacting the inner surface of the fixing belt 13. The retracting mechanism functions to prevent the fixing belt from being stuck by the thermister 19 and/or the grounding contact member 21 in the exchange of the fixing belt (removal of the used belt and insertion of the fresh belt). In this example, the thermister and the grounding contact member are retracted from the operating position thereof (the position for detecting the temperature of the fixing belt or the position for grounding the fixing belt) to the position for permitting the exchange of the fixing belt.

Figure 1:
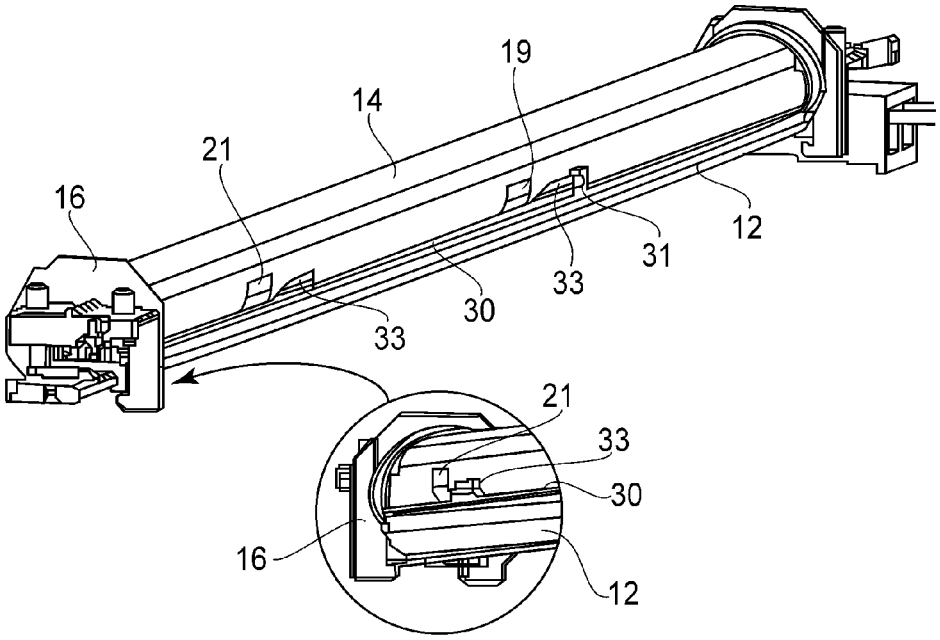
FIG. 1 is a fixing device as an image heating apparatus according to an embodiment of the present invention, in which (a) is a perspective view when an end portion limiting member is in a first state, and (b) is a perspective view when the end portion limiting member is in a second state.
Figure 1:
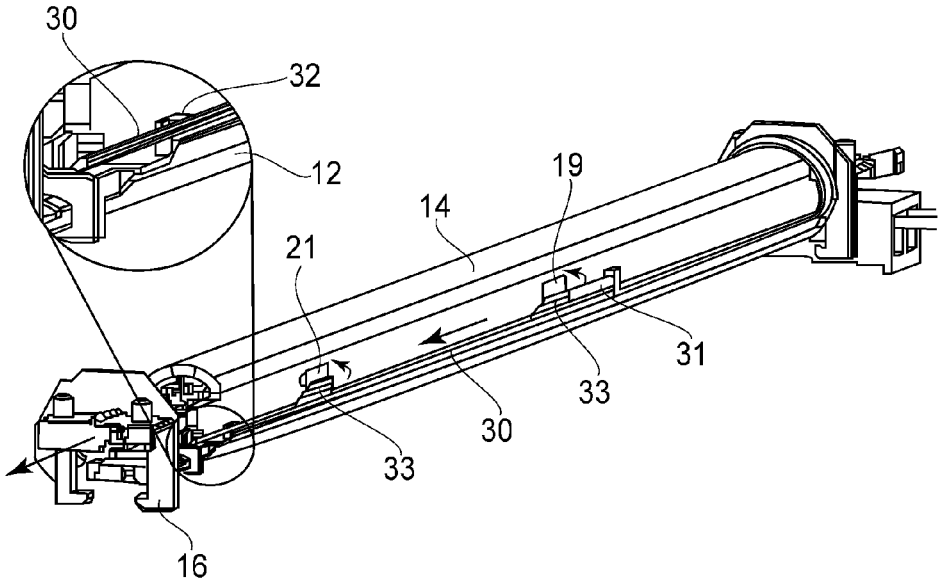

As shown in parts (a) and (b) of FIG. 1, the heat-insulation holder 12 is provided with a retraction lever 30 as the retracting member. More specifically the retraction lever 30 is connected with the heat-insulation holder 12 so as to be movable (capable of thrusting) in the longitudinal direction of the heat-insulation holder 12 (a rotational axial direction of the rotatable member (fixing belt)). One end portion of the retraction lever 30 is connected with the heat-insulation holder 12 through an urging member 31.

In the retraction lever 30, when the flange 16 as the limiting member is mounted to the stay 14 (first state), it is placed in a first thrust position (part (a) of FIG. 1) where a stopper 32 as a stopper portion is pressed against the flange 16. On the other hand, when the flange 16 is removed upon the exchange of the endless belt (second state), it is in a second thrust position (part (b) of FIG. 1) where the stopper 32 is pressed against the heat-insulation holder 12. The flange 16 in the first state limits the movement of the fixing belt 13 in the direction (longitudinal direction) crossing with the rotational direction, whereas the flange 16 in the second state permits the movement of the fixing belt 13 in the direction crossing with the rotational direction.

Figure 5:
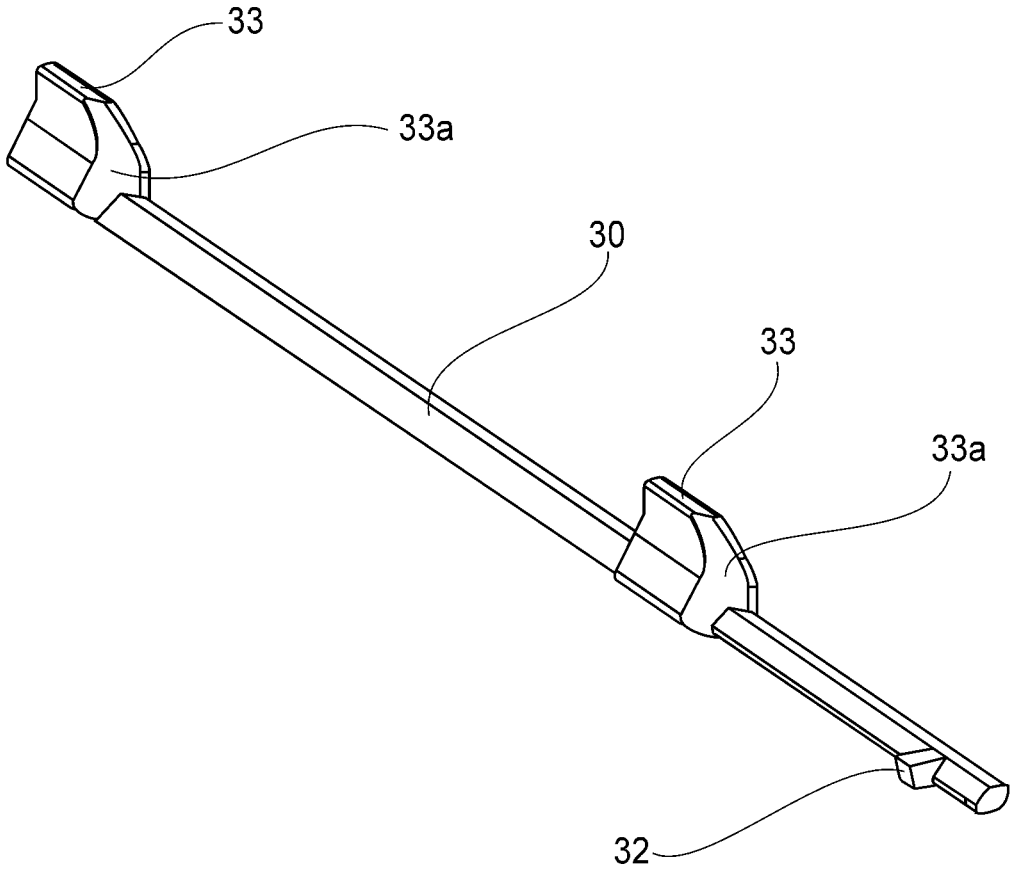
FIG. 5 is a perspective view of an arm member as a retracting member in the image heating apparatus according to the embodiment of the present invention.

As shown in FIG. 5, the retraction lever 30 as the endless belt exchanging unit is provided with projections 33 each having an inclined surface 33*a* as an operating portion for retracting the thermister 19 and the ground 21 from the inner surface of the fixing belt 13 at the second thrust position. More particularly, the inclined surfaces 33*a* of the projection 33 are effective to slide the thermister 19 and the ground 21 thereon to retract them from the inner surface of the fixing belt 13.

That is, when the flange 16 is removed, and the retraction lever 30 is moved from the first thrust position to the second thrust position in the thrust direction, the thermister 19 and the ground 21 slide on the inclined surfaces 33*a* to retract from the inner surface of the fixing belt 13. By the retracting mechanism, the thermister 19 and the ground 21 are kept away from the fixing belt.

When a predetermined number of fixing operations of the fixing device having such a structure, the fixing belt 13 is worn out, and sliding resistances between the fixing belt 13 and the heater 11 and the heat-insulation holder 12 increase by the produced debris. As a result, the fixing belt 13 is not rotated by the pressing roller 20, and the recording material P cannot be fed properly, and/or a damage occurs on the surface of the fixing belt 13 due to the press-contact with the end portion of the recording material P, and therefore, the image quality is deteriorated. At the time of such a state, the fixing belt 13 is exchanged.

In such a case, the flange 16 for limiting the movement of the urging spring 15 and the fixing belt 13 in the thrust is dismounted, so that the fixing belt 13 becomes capable of being pulled out of the fixing assembly 10, and the worn fixing belt 13 can be exchanged. More particularly, when the urging spring 15 and the flange 16 are dismounted, the retraction lever 30 moves from the first thrust position to the second thrust position in the thrust direction. By this, the thermister 19 and the ground 21 are retracted from the inner surface of the fixing belt 13, by which the thermister 19 and the ground 21 are not slid on the inner surface of the fixing belt 13 when the used fixing belt 13 is pulled out.

In addition, when a fresh fixing belt 13 is mounted to the fixing assembly 10 (telescoped), the thermister 19 and the ground 21 are retracted inwardly beyond the inner surface position of the fixing belt 13, and therefore, it can be telescoped without interference with the fixing belt 13 and the ground 21. By mounting the flange 16 to the stay 14 after telescoping the fresh fixing belt 13, the retraction lever 30 is moved by the flange 16 to the first thrust position. As a result, the projection 33 is disengaged from the thermister 19 and the ground 21, so that the thermister 19 and the ground 21 can be contacted to the inner surface of the fixing belt 13.

As described in the foregoing, with the fixing device according to this embodiment, when the fixing belt is mounted to the belt unit, the collision of the inner surface of the belt to the contact member or members can be minimized or prevented, and therefore, it becomes unnecessary to exchange entire fixing assembly 10 or the entire fixing device all together. That is, the belt per se can be exchanged without damage or denting of the inner surface of the belt. By this operation, the abnormal wearing of the belt in the exchanging operation and the deterioration of the image quality can be avoided, and by continuing use without wasting a usable part to protect the ambient condition, the reduction of the cost can be accomplished.

MODIFIED EXAMPLE 1

In the foregoing embodiment, the heating device is a ceramic heater, but the present invention is not limited to a particular heating type. That is, the present invention is applicable to an electromagnetic induction heating type in which the fixing belt is provided with an electroconductive layer which generates heat by electromagnetic induction heating source, or to a type in which the fixing belt is provided with a heat generation layer which generates heat by electric power supply, or the like type.

MODIFIED EXAMPLE 2

In the foregoing embodiment, the pressing member (rotatable member) is a pressing roller, but the present invention is not limited to it, but a fixed pressing pad is usable in place of the pressing roller.

MODIFIED EXAMPLE 3

The image heating apparatus of the present invention is applicable not only to the fixing device for fixing the unfixed toner image on the recording material, described in the foregoing, but also to a glossiness improving device for improving a glossiness of the image by heating the toner image already fixed on the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 131782/2012 filed Jun. 11, 2012 which is hereby incorporated by reference.

What is claimed is:

1. An image heating apparatus comprising:

an endless belt for heating a toner image on a recording material;

a holding member for holding said endless belt at an inside of said endless belt;

a temperature sensor, provided inside said endless belt, for detecting a temperature of the endless belt; and a moving mechanism moved said temperature sensor between a first position for detecting the temperature of the endless belt and a second position for permitting said endless belt to be taken out of said holding member substantially along a longitudinal direction of said holding member.

2. An apparatus according to claim 1, further comprising a limiting member, dismountably provided on said holding member, for limiting movement of said endless belt in the longitudinal direction, wherein said moving mechanism moves said temperature sensor from the first position to the second position in interrelation with a dismounting operation of said limiting member.

3. An apparatus according to claim 1, further comprising a heating device for heating said endless belt in accordance with an output of the temperature sensor.

4. An apparatus according to claim 1, further comprising a rotatable member cooperative with said endless belt to form a nip for nipping and feeding the recording material, said rotatable member being effective to rotate said endless belt.

5. An image heating apparatus comprising:

an endless belt for heating a toner image on a recording material;

a holding member for holding said endless belt at an inside of said endless belt; and a temperature sensor for detecting a temperature of the endless belt by contacting to an inner surface of the endless belt;

a retracting mechanism for retracting said temperature sensor from said endless belt, and for maintaining the retracted state of said temperature sensor when said endless belt is taken out of said holding member along a longitudinal direction of said holding member.

6. An apparatus according to claim 5, further comprising a limiting member, dismountably provided on said holding member, for limiting movement of the endless belt in the longitudinal direction, said retracting mechanism interrelates a retracting operation of said temperature sensor with the dismounting operation of said limiting member.

7. An apparatus according to claim 5, further comprising a heating device for heating said endless belt in accordance with an output of the temperature sensor.

8. An apparatus according to claim 5, further comprising a rotatable member cooperative with said endless belt to form a nip for nipping and feeding the recording material, said rotatable member being effective to rotate said endless belt.

9. A belt exchanging method in an image heating apparatus which includes an endless belt for heating a toner image on a recording material, a holding member for holding said endless belt at an inside thereof, a temperature sensor for detecting a temperature of the endless belt by contacting an inner surface of the endless belt, said belt exchanging method comprising:

a step of retracting said temperature sensor from said endless belt;

a step of taking said endless belt out of said holding member along a longitudinal direction of said holding member, in a state that said temperature sensor is retracted from said endless belt;

a step of telescoping a replaced endless belt to replace said endless belt taken out of said holding member along the longitudinal direction around said holding member in the state that said temperature sensor is retracted from said replaced endless belt; and a step of contacting said temperature sensor to an inner surface of the replaced endless belt.

10. A method according to claim 9, further comprising a step of dismounting a limiting member for limiting movement of the endless belt in the longitudinal direction from said holding member, and a step of mounting said limiting member to said holding member, wherein said limiting member dismounting step and said temperature sensor retraction step are interrelated with each other, and said limiting member mounting step and said temperature sensor contacting step are interrelated with each other.

11. An image heating apparatus comprising:

an endless belt for heating a toner image on a recording material;

a holding member for holding said endless belt at an inner surface of said endless belt;

a grounding member for contacting to an inner surface of the endless belt to ground said endless belt; and a retracting mechanism for retracting said grounding member from said endless belt, and for maintaining the retracted state of said grounding member when said endless belt is taken out of said holding member along a longitudinal direction of said holding member.

12. An apparatus according to claim 11, further comprising a limiting member, dismountably provided on said holding member, for limiting movement of the endless belt in the longitudinal direction, wherein said retracting mechanism interrelates the retracting operation of the grounding member with the dismounting operation of said limiting member.

13. An apparatus according to claim 11, further comprising a rotatable member cooperative with said endless belt to form a nip for nipping and feeding the recording material, said rotatable member being effective to rotate said endless belt.

14. A belt exchanging method in an image heating apparatus which includes an endless belt for heating a toner image on a recording material, a holding member for holding said endless belt at an inside thereof, a grounding member for grounding by contacting an inner surface of the endless belt, said belt exchanging method comprising:

a step of retracting said grounding member from said endless belt;

a step of taking said endless belt out of said holding member along a longitudinal direction of said holding member, in a state that said grounding member is retracted from said endless belt;

a step of telescoping a replaced endless belt to replace said endless belt taken out of said holding member along the longitudinal direction around said holding member in the state that said grounding member is retracted from said replaced endless belt; and a step of contacting said grounding member to an inner surface of the replaced endless belt.

15. A method according to claim 14, further comprising a step of dismounting a limiting member for limiting movement of the endless belt in the longitudinal direction from said holding member, and a step of mounting said limiting member to said holding member, wherein said limiting member dismounting step and said grounding member retraction step are interrelated with each other, and said limiting member mounting step and said grounding member contacting step are interrelated with each other.

16. An image heating apparatus comprising:

an endless belt for heating a toner image on a recording material in a nip;

a rotatable member for cooperating with said endless belt to form the nip and rotating said endless belt;

a holding member, provided opposed to said rotatable member through said endless belt, for holding said endless belt at an inside of said endless belt and for contacting said endless belt to heat said endless belt;

a contact member contacting an inner surface of the endless belt; and a retracting mechanism for retracting said contact member from said endless belt, and for maintaining the retracted state of said contact member when said endless belt is taken out of said holding member along a longitudinal direction of said holding member.

17. An apparatus according to claim 16, further comprising a limiting member, dismountably provided on said holding member, for limiting movement of the endless belt in the longitudinal direction, said retracting mechanism interrelates a retracting operation of said contact member with the dismounting operation of said limiting member.

18. A belt exchanging method in an image heating apparatus which includes an endless belt for heating a toner image on a recording material in a nip, a rotatable member for cooperating with said endless belt to form the nip and rotating said endless belt, a holding member, provided opposed to said rotatable member through said endless belt, for holding said endless belt at an inside of said endless belt and for contacting said endless belt to heat said endless belt, and a contact member contacting an inner surface of the endless belt, said belt exchanging method comprising:

a step of retracting said contact member from said endless belt;

a step of taking said endless belt out of said holding member along a longitudinal direction of said holding member, in a state that said contact member is retracted from said endless belt;

a step of telescoping a replaced endless belt to replace said endless belt taken out of said holding member along the longitudinal direction around said holding member in the state that said contact member is retracted from said replaced endless belt; and a step of contacting said temperature sensor to an inner surface of the replaced endless belt.

19. A method according to claim 18, further comprising a step of dismounting a limiting member for limiting movement of the endless belt in the longitudinal direction from said holding member, and a step of mounting said limiting member to said holding member, wherein said limiting member dismounting step and said contact member retraction step are interrelated with each other, and said limiting member mounting step and said contact member contacting step are interrelated with each other.

* * * * *